US005150720A

United States Patent [19]

Focke et al.

[11] Patent Number: 5,150,720

[45] Date of Patent: Sep. 29, 1992

[54] CUBOIDAL PACK, ESPECIALLY HINGE LID PACK FOR CIGARETTES

[75] Inventors: Heinz Focke, Verden; Hans-Jürgen Bretthauer, Bremen, both of Fed. Rep. of Germany

[73] Assignee: Focke & Co., Verden, Fed. Rep. of Germany

[21] Appl. No.: 658,013

[22] Filed: Feb. 20, 1991

[30] Foreign Application Priority Data

Feb. 21, 1990 [DE] Fed. Rep. of Germany ..... 4005443

[51] Int. Cl.[5] ..... A24F 15/00

[52] U.S. Cl. ..... 131/329; 206/268; 206/273; 206/264; 229/160.1

[58] Field of Search ..... 131/329, 330, 187; 206/264, 268, 273, 242; 229/160.1

[56] References Cited

U.S. PATENT DOCUMENTS 4,196,842 4/1980 Focke et al. .

FOREIGN PATENT DOCUMENTS 346026 12/1989 European Pat. Off. .
193808 1/1938 Fed. Rep. of Germany .
6947368 4/1970 Fed. Rep. of Germany .
7119018 10/1972 Fed. Rep. of Germany .
7629556 4/1977 Fed. Rep. of Germany .
2759178 7/1979 Fed. Rep. of Germany .
2813390 10/1979 Fed. Rep. of Germany .
3509232 9/1986 Fed. Rep. of Germany .
3819874 1/1989 Fed. Rep. of Germany .
3727489 3/1989 Fed. Rep. of Germany .
2059387 4/1981 United Kingdom .

*Primary Examiner*—V. Millin
*Assistant Examiner*—J. Doyle
*Attorney, Agent, or Firm*—Sughrue, Mion, Zinn, Macpeak & Seas

[57] ABSTRACT

It is a problem with hinge lid packs for cigarettes, that the pack content (cigarette block 29) often has a smaller depth than the interior space of the pack, so that the cigarette block (29) has to be supported by a filling piece. This filling piece is provided in the form of a supporting body (31) which is formed by appropriate folding of a collar front wall (25) from a collar arranged in the pack. An upper portion of the collar front wall (25) is inwardly set back, such that a supporting wall (32) abuts the (smaller) cigarette block (29). Collar side tabs (26, 27) connected to the collar front wall (25) extend across the full depth of the interior space of the pack and are connected to the supporting wall (32) via panels (37, 38) folded parallel.

4 Claims, 4 Drawing Sheets

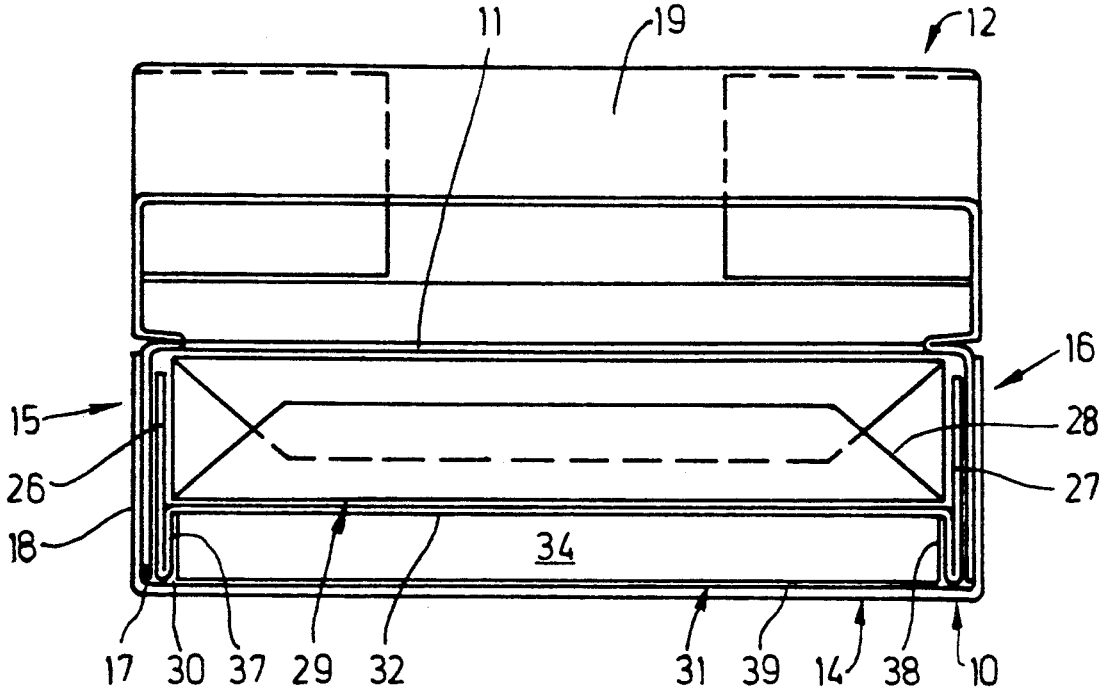
Fig. 3
Fig. 4
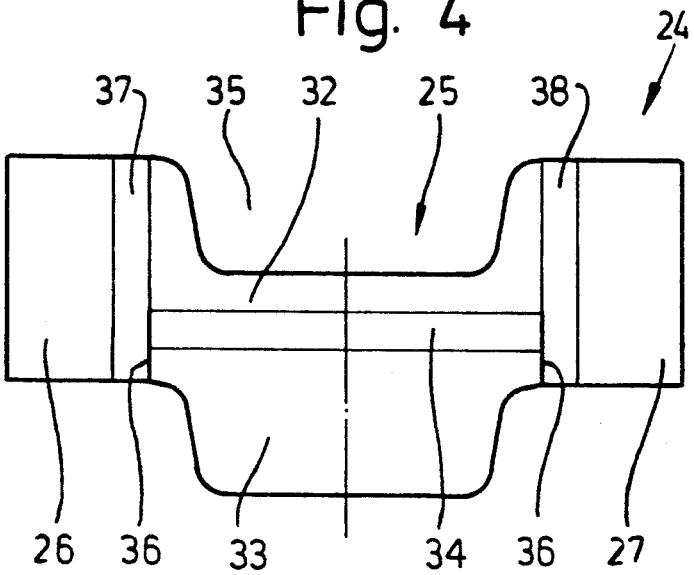

CUBOIDAL PACK, ESPECIALLY HINGE LID PACK FOR CIGARETTES

BACKGROUND OF THE INVENTION

The invention relates to a cuboidal pack made of (thin) cardboard, especially a hinge lid pack for accommodating a group of cigarettes wrapped in an inner blank (cigarette block), the dimensions of said group of cigarettes, especially the depth, being smaller than the corresponding dimension of the pack, with a filling piece being arranged in a cavity located within the pack.

Hinge lid packs are used world-wide as cigarette packs. The structure of this pack type is mostly standardized. This applies to the dimensions as well. Any changes in size have far-reaching consequences.

Vending machines for cigarette packs would, for instance, have to be designed differently. In some counties, revenue stamps are stamped on the packs, and the stamping units are designed for standard pack dimensions.

On the other hand, cigarettes with a substantially smaller diameter than standard cigarettes are increasingly introduced. Consequently, an identical number of such cigarettes forms a cigarette block with a smaller dimension, especially with a smaller depth. As a result, a cavity is formed within the pack which is (partially) filled by filling pieces made of foamed material or corrugated cardboard.

SUMMARY OF THE INVENTION

The invention is concerned with packs of the aforementioned kind and with the problem caused by the block-shaped pack contents having smaller dimensions than the interior space of the pack.

The invention is based on the object to improve the pack as regards type, design and arrangement of the filling piece, such that the latter requires a smaller expenditure of material and is located in an advantageous position within the pack.

In order to attain this object, the pack as taught by the invention is characterized in that the filling piece consists of a blank of (thin) cardboard forming part of the pack, said blank being folded to a three-dimensional form and extending across the full-width of the interior space or cavity of the pack According to the invention, the filling piece is formed by part of a blank which is commonly used in the pack, said filling piece being designed such that it extends across the full width of the pack or cavity. As a result, the cigarette block forming the pack contents is supported across the full width.

In a particularly advantageous embodiment of the invention, a spacer is formed by a collar front wall of a collar arranged in a pack of the hinge lid type in the standard way. According to this embodiment, the collar front wall is provided with an indentation or inwardly directed projection extending across the width of the pack and formed by folding, said indentation or inwardly directed projection extending across the full width of the interior of the pack, with the cigarette block forming the pack contents abutting thereto.

According to the invention, this supporting body formed by folding in the region of the collar front wall is arranged in the upper region of the collar front wall, so that a portion surrounding a customary recess in the collar front wall is inwardly set back, i.e., projects inwardly of the pack from the collar front wall while the other, lower portion of the collar front wall abuts the inside of the pack front wall or box front wall and is connected thereto. The supporting body of the collar front wall is limited below by a supporting wall transversely extending across the width of the collar front wall. According to the invention, this supporting wall is (approximately) flush with an upper free edge of the box front wall. Said supporting wall may also be arranged at a distance underneath the free edge of the front wall. In this case, a chamber open at the top is formed within the pack.

According to a further proposal of the invention, the collar front wall is folded for forming the supporting body such that collar side tabs extend across the full depth of the (interior space of the) pack. The collar side tabs are connected to the set-back supporting wall of the supporting body via a folding panel.

Further features of the invention relate to the design and arrangement of the supporting body. Exemplary embodiments of the invention will be described below in more detail with reference to the drawings, in which:

BRIEF DESCRIPTION OF THE DRAWINGS

FIG. 3 is a top plan view of an opened pack on an enlarged scale,

FIG. 4 shows a collar blank in spread-out position,

DESCRIPTION OF PREFERRED EMBODIMENTS

Figure 2:
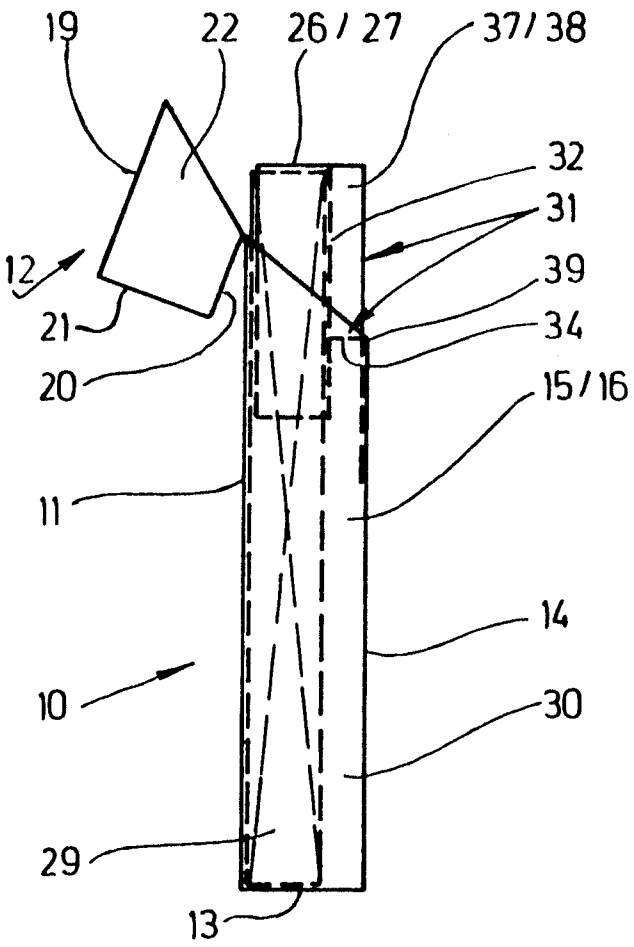
FIG. 2 is a side view of the representation of FIG. 1.
Figure 1:
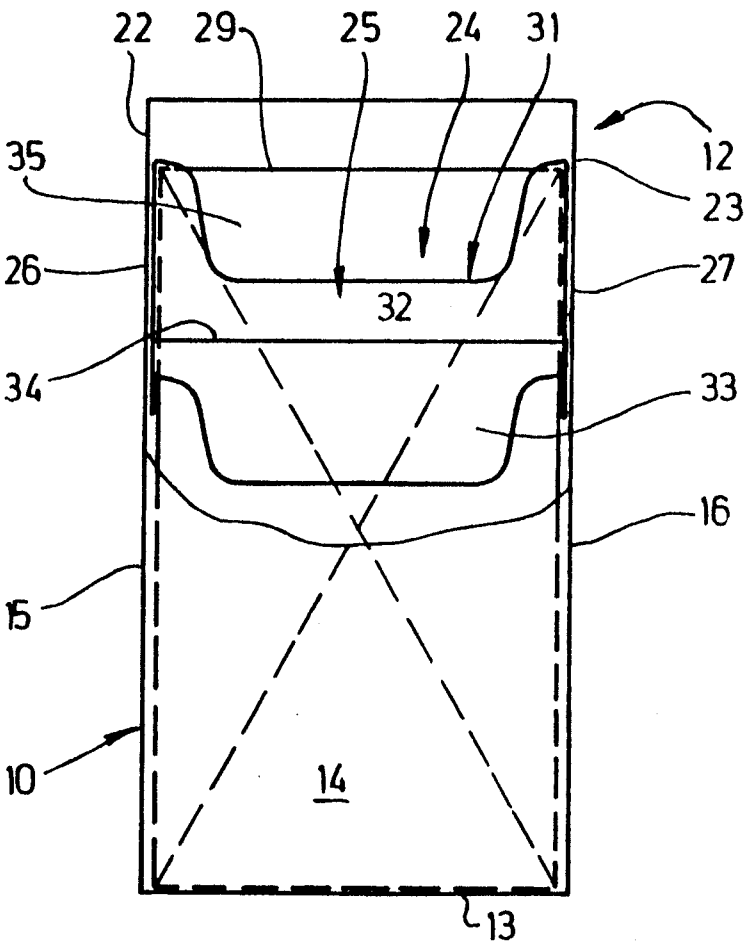
FIG. 1 is a front view of a hinge lid box in open position.

The details of the drawings relate to packs of the hinge lid type. Such a pack consists of a box part 10 (FIGS. 1 and 2) and a hinged lid 12 pivotably attached to a box rear wall 11. The box part 10 further consists of a bottom wall 13 and a box front wall 14. Box side walls 15, 16 are formed by inner and outer side tabs 17, 18 (FIG. 3) which overlap one another and which are connected to the box rear wall 11 (inner side tabs 17) and to the box front wall 14 (outer side tabs 18), respectively.

The hinged lid 12 also consists of lid front wall 19, lid rear wall 20, an end top wall 21 and lid side walls 22, 23.

Figure 5:
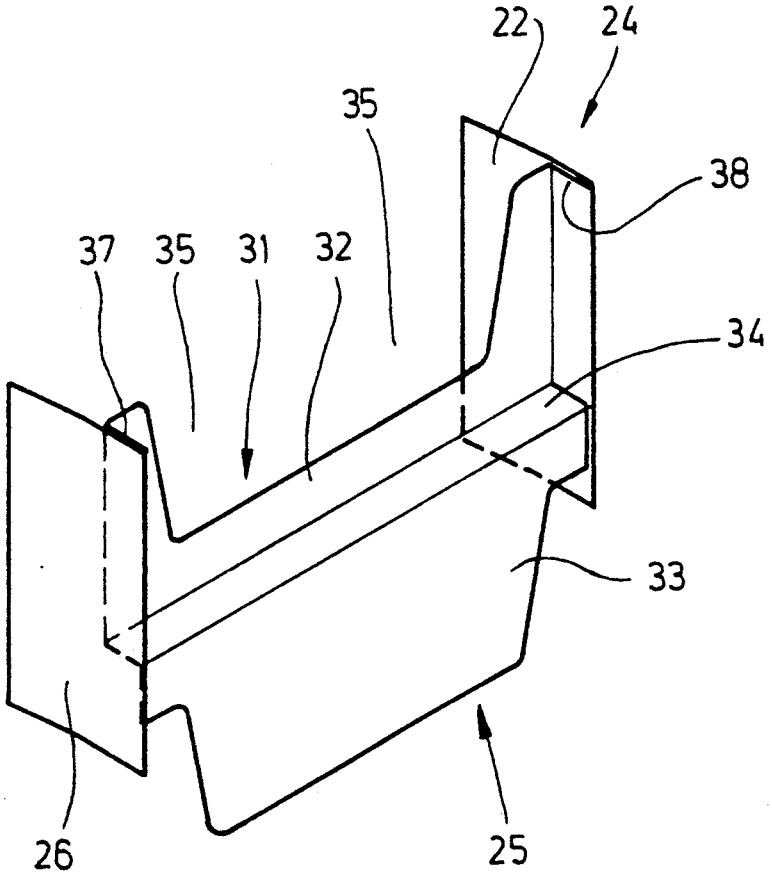
FIG. 5 is a perspective detail view of the folded collar.

The pack further comprises a collar 24, which in the present embodiment is formed as a separate blank (FIGS. 4 and 5).

The collar 24 consists of a collar front wall 25 and collar side tabs 26, 27.

The collar 24 is arranged in the standard way with its lower portion inside the box part 10. A lower portion of the collar front wall abuts the box front wall 14 and is adhesively connected therewith. Correspondingly, lower portions of the collar side tabs 26, 27 abut the inside of the box side walls 15, 16 and, if necessary, are also adhesively connected therewith. An upper portion of the collar projecting from the box part 10 is enclosed by the hinged lid 12 when the pack is in closed position.

The cuboidal pack, made of thin cardboard and designed in this way, is particularly suitable for accommodating cigarettes or other cuboidal articles. The cigarettes are grouped in cigarette groups and are enwrapped by an inner blank 28 (made of tine foil). As a result, a cuboidal cigarette block 29 is formed.

The cigarette block 29, forming the pack contents, has a smaller depth (dimension between box rear wall 11 and box front wall 14) than the corresponding dimension of the interior space of the pack. As a result, a cavity 30 of formed in the pack, which is not filled by the pack contents. In this cavity 30, there is located a filling piece, which partially fills the cavity 30 and supports the cigarette block 29, so that the latter is held within the pack practically without any play.

In the shown preferred embodiment of the pack, the cavity 30 is located in the front region of the pack. Consequently, the cigarette block 29 abuts the box rear wall 11.

Here, the filling piece consists of a portion of the standard pack, namely of a portion of the collar 24. The collar front wall 25, by means of appropriate folding, forms a supporting body 31 extending practically across the full width of the pack, that is to say the interior space thereof. This supporting body 31 forms a cuboidal hollow body together with further parts of the pack, namely together with the lid front wall 19 and possibly the box front wall 14.

To form the supporting body 31, the collar front wall 25 is angularly folded about halfway up its vertical height, such that an upper supporting wall 32 is inwardly indented or set back (i.e., projects inwardly) into the pack relative to a lower connecting tab 33 of the collar front wall 25. Supporting wall 32 and connecting tab 33 are connected to one another via a transversely directed folding strip 34 of the collar front wall 25. As a result, a preferably rectangular step is formed in the region of the collar front wall 25. Supporting wall 32 and transversely directed folding strip 34 extend across the full width of the interior space of the pack, namely from the one collar side tab 26 (folded into a transverse position) to the other collar side tab 27. The supporting wall 32 is provided with the customary recess 35 that is upwardly open, so that the supporting wall 32 takes a U-shaped form.

The collar side tabs 26, 27 are connected to the collar front wall 25 only in the region of the inwardly set-back (i.e., inwardly projecting or indented) supporting wall 32. In the region of folding strip 34 and lower connecting tab, collar side tabs 26, 27 are separated from the collar front wall 25 by means of vertical severing cuts 36 in the collar blank (FIG. 4).

As a result, the collar can be folded as shown in FIG. 5. The width of the blank for the collar 24 (FIG. 4) is greater than in ordinarily designed packs. Between the collar side tabs 26, 27 on the one hand and the collar front wall 25 on the other hand, a panel 37, 38 is formed. These panels 37, 38 are folded with the supporting wall 32, such that they abut the inside of the collar side tabs 26, 27. The collar 24, that is to say the supporting body 31, thus receives a stable three-dimensional form. The collar side tabs 26, 27 extend across the full depth of the interior space of the box part 10 and form strong supporting members due to the partially double-walled construction.

The connecting tab 33 has a tongue-shaped lower portion and is connected in the usual way with the inside of the box front wall 14 by adhesive bonding.

Figure 6:
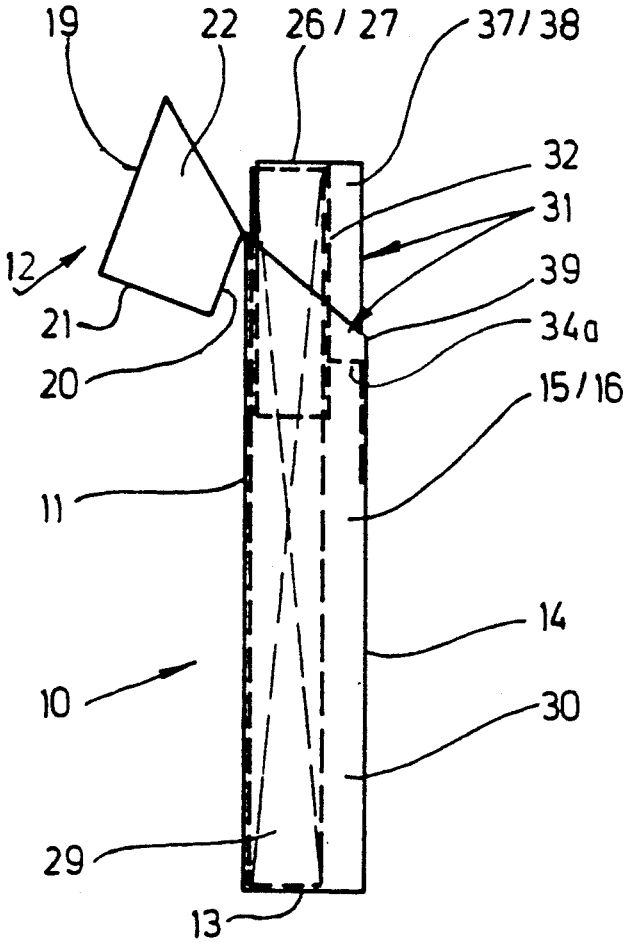
FIG. 6 is a side view (similar to FIG. 2) of another embodiment of the invention.

In the embodiment described above, the folding strip 34 is arranged at the height of an upper front free edge 39 of the box part 10, i.e. flush therewith. In another embodiment (FIG. 6), the collar may also be folded such that the folding strip 34*a* and therewith the step formed in the collar front wall 25, is located lower, than the front edge 39 i.e. within the box part 10. As a result, an upwardly open chamber is formed in the front upper region of the box part 10, which is suitable for accommodating auxiliary articles such as matches.

The supporting body 31 formed and arranged in the abovedescribed way is located at a height within the pack which is advantageous for fixing the cigarette block 29 in place. The supporting body 31 is technically easy to produce and requires only a small expenditure of material.

What is claimed is:

1. In a cuboidal hinge-lid pack made of thin cardboard and having a collar; said pack containing an interior cigarette block in the form of a group of cigarettes wrapped in a wrapper; said pack having a hinged lid (12), a pack rear wall (11) to which the lid is hinged, two pack side walls (15, 16), a bottom wall (13) and a pack front wall (14), all of which walls define an interior volume having a height, width and depth; said pack having a front wall-to-rear wall depth which is greater than that of the cigarette block, thereby forming in said pack a front cavity (30) having a depth and a width which is equal to the width of said volume the improvement wherein:

said front cavity is located in a front portion of the pack and is bounded by the pack front wall (14);

the collar (24) is formed from a blank of thin cardboard and is angularly folded in three dimensions to form in said front cavity (30) a filling piece which supports the cigarette block between the pack rear wall (11) and the filling piece;

the collar (24) comprises only a collar front wall (25), located in aid front collar (30) near said pack front wall (14), and collar side tabs (26, 27) abutting said pack side wall (15, 16), and has no rear wall, said collar front wall (25) and said collar side tabs (26, 27) extending around only an upper portion of the pack and around only said pack front (14) and side (15, 16) walls;

the collar (24) extends over the entire width of said front cavity (30); and the folded collar comprises: in a lower portion of said collar front wall (25), a lower connecting tab (33) abutting, and secured to, the pack front wall (14); in an upper portion of said collar front wall (25), an upper upright supporting wall (32) for supporting the cigarette block, said upright supporting wall (32) being inwardly set back into the interior volume of the pack relative to said lower connecting tab (33); and a folding strip, interconnecting said upper upright supporting wall (32) and said lower connecting tab (33), and defining a step.

2. The pack as claimed in claim 1, wherein the collar side tabs (26, 27) have a depth equal to that of the interior volume of the pack and extend up to the pack front wall (14), said collar side tabs (26, 27) being connected with said inwardly set-back supporting wall (32) via a pair of parallel extending panels (37, 38) which respectively abut insides of the collar side tabs (26, 27).

3. The pack as claimed in claim 1, wherein said step (34) is flush with a free upper edge (39) of the front wall (14) of the pack (10).

4. The pack as claimed in claim 1, wherein said step (34) is below a free upper edge (39) of the pack front wall (14) and forms, with the pack front wall (14) and the upright supporting wall (32), an upwardly open chamber.

* * * * *